US006295801B1

(12) United States Patent
Burrus et al.

(10) Patent No.: US 6,295,801 B1
(45) Date of Patent: Oct. 2, 2001

(54) FUEL INJECTOR BAR FOR GAS TURBINE ENGINE COMBUSTOR HAVING TRAPPED VORTEX CAVITY

(75) Inventors: David L. Burrus; Arthur W. Johnson, both of Cincinnati, OH (US)

(73) Assignee: General Electric Company, Cincinnati, OH (US)

( * ) Notice: Subject to any disclaimer, the term of this patent is extended or adjusted under 35 U.S.C. 154(b) by 0 days.

(21) Appl. No.: 09/215,863

(22) Filed: Dec. 18, 1998

(51) Int. Cl.[7] ..... F02C 7/08

(52) U.S. Cl. ..... 60/39.06; 60/737; 60/750; 60/751; 60/742

(58) Field of Search ..... 60/737, 732, 742, 60/749, 750, 751, 39.06

(56) References Cited

U.S. PATENT DOCUMENTS

| | | | | |
|---|---|---|---|---|
| 3,034,297 | * | 5/1962 | Orchard | 60/749 |
| 3,299,632 | * | 1/1967 | Wilde | 60/751 |
| 3,620,012 | * | 11/1971 | Wilde | 60/749 |
| 3,675,419 | * | 7/1972 | Lewis | 60/39.36 |
| 3,973,390 | * | 8/1976 | Jeroszko | 60/737 |
| 4,455,839 | * | 6/1984 | Wuchter | 60/737 |
| 4,455,840 | * | 6/1984 | Matt et al. | 60/737 |
| 4,563,875 | * | 1/1986 | Howald | 60/737 |
| 5,207,064 | * | 5/1993 | Ciokajlo et al. | 60/737 |
| 5,335,490 | * | 8/1994 | Johnson et al. | 60/749 |
| 5,619,855 | | 4/1997 | Burrus | 60/736 |
| 5,657,632 | * | 8/1997 | Foss | 60/742 |
| 5,791,148 | | 8/1998 | Burrus | 60/752 |
| 5,802,854 | * | 9/1998 | Maeda et al. | 60/737 |
| 5,813,232 | * | 9/1998 | Razdan et al. | 60/737 |
| 5,885,068 | * | 3/1999 | Dobbeling et al. | 60/737 |
| 6,047,550 | * | 4/2000 | Beebe | 60/737 |

* cited by examiner

*Primary Examiner*—Ted Kim
(74) *Attorney, Agent, or Firm*—Andrew C. Hess; William Scott Andes

(57) ABSTRACT

A fuel injection system for a gas turbine engine combustor, wherein the combustor includes a dome inlet module having a plurality of flow passages formed therein and at least one cavity formed in a liner downstream of said dome inlet module. The fuel injection system includes a fuel supply and a plurality of fuel injector bars positioned circumferentially around and interfacing with the inlet dome module. The fuel injector bars are in flow communication with the fuel supply, with each of the fuel injector bars further including a body portion having an upstream end a downstream end, and a pair of sides. A plurality of injectors formed in the body portion and in flow communication with the fuel supply, whereby fuel is provided to the dome inlet module flow passages and/or the cavity through the fuel injector bars.

14 Claims, 3 Drawing Sheets

FUEL INJECTOR BAR FOR GAS TURBINE ENGINE COMBUSTOR HAVING TRAPPED VORTEX CAVITY

The Government has rights to this invention pursuant to Contract No. F33615-93-C-2305 awarded by the United States Air Force.

BACKGROUND OF THE INVENTION

1. Field of the Invention

The present invention relates to a gas turbine engine combustor having at least one trapped vortex cavity and, more particularly, to a fuel injector bar used for injecting fuel into such cavity and flow passages of a dome inlet module providing high inlet air flows to the combustion chamber.

2. Description of Related Art

Advanced aircraft gas turbine engine technology requirements are driving the combustors therein to be shorter in length, have higher performance levels over wider operating ranges, and produce lower exhaust pollutant emission levels. One example of a combustor designed to achieve these objectives is disclosed in U.S. Pat. No. 5,619,855 to Burrus. As seen therein, the Burrus combustor is able to operate efficiently at inlet air flows having a high subsonic Mach Number. This stems in part from a dome inlet module which allows air to flow freely from an upstream compressor to the combustion chamber, with fuel being injected into the flow passage. The combustor also has inner and outer liners attached to the dome inlet module which include upstream cavity portions for creating a trapped vortex of fuel and air therein, as well as downstream portions extending to the turbine nozzle.

It will be noted in the aforementioned Burrus combustor that the fuel is injected into the trapped vortex cavities through a portion of the liner forming an aft wall of such cavity. Fuel is also injected into the flow passages of the dome inlet module via atomizers located along hollow vanes of the dome inlet module, the vanes being in flow communication with a fuel manifold. While functional for its intended purpose, it has been found that the fuel injection approach taken in the '855 patent lacks simplicity. In particular, it will be understood that this design requires the occupation of significant space within the combustor housing cavity, as separate systems are utilized for injecting the fuel into the cavities and the dome inlet module. This not only represents a large cost from a manufacturing standpoint, but extraction of fuel injectors from the engine for repair or replacement requires a major tear down of the engine to expose the combustor cavity section.

Accordingly, it would be desirable for a fuel injection system to be developed in which the cavity sections of a combustion chamber and the flow passages providing air flow thereto can be provided fuel in a simpler design requiring less space. Further, it would be desirable if such fuel injection system would be constructed so as to interface with the dome inlet module in a manner which enables easy access to the fuel injectors for repair and replacement.

SUMMARY OF THE INVENTION

In accordance with one aspect of the present invention, a fuel injection system for a gas turbine engine combustor is disclosed, wherein the combustor includes a dome inlet module having a plurality of flow passages formed therein and at least one cavity formed in a liner downstream of said dome inlet module. The fuel injection system includes a fuel supply and a plurality of fuel injector bars positioned circumferentially around and interfacing with the inlet dome module. The fuel injector bars are in flow communication with the fuel supply, with each of the fuel injector bars further including a body portion having an upstream end, a downstream end, and a pair of sides. Injectors are provided in openings formed in the body portion and are in flow communication with the fuel supply, whereby fuel is provided to the dome inlet module flow passages and/or the cavity through the fuel injector bars.

In accordance with a second aspect of the present invention, a method of operating a gas turbine engine combustor is disclosed where the combustor includes a dome inlet module having a plurality of flow passages formed therein and at least one cavity formed within a combustion chamber by a liner downstream of the dome inlet module. The method includes the steps of injecting fuel into an upstream end of the cavity, injecting air into the cavity to create a trapped vortex of fuel and air therein, igniting the mixture of fuel and air in the cavity to form combustion gases, providing a flow of main stream air from a compressor upstream of the dome inlet module into and through the flow passages, and exhausting the cavity combustion gases across a downstream end of the dome inlet module so as to interact with the main stream air. The method may also include the steps of injecting fuel into the dome inlet module flow passages so as to mix with the main stream air and igniting the mixture of fuel and main stream air by the cavity combustion gases exhausting across the dome inlet module downstream end.

BRIEF DESCRIPTION OF THE DRAWING

While the specification concludes with claims particularly pointing out and distinctly claiming the present invention, it is believed that the same will be better understood from the following description taken in conjunction with the accompanying drawing in which:

DETAILED DESCRIPTION OF THE INVENTION

Figure 1:
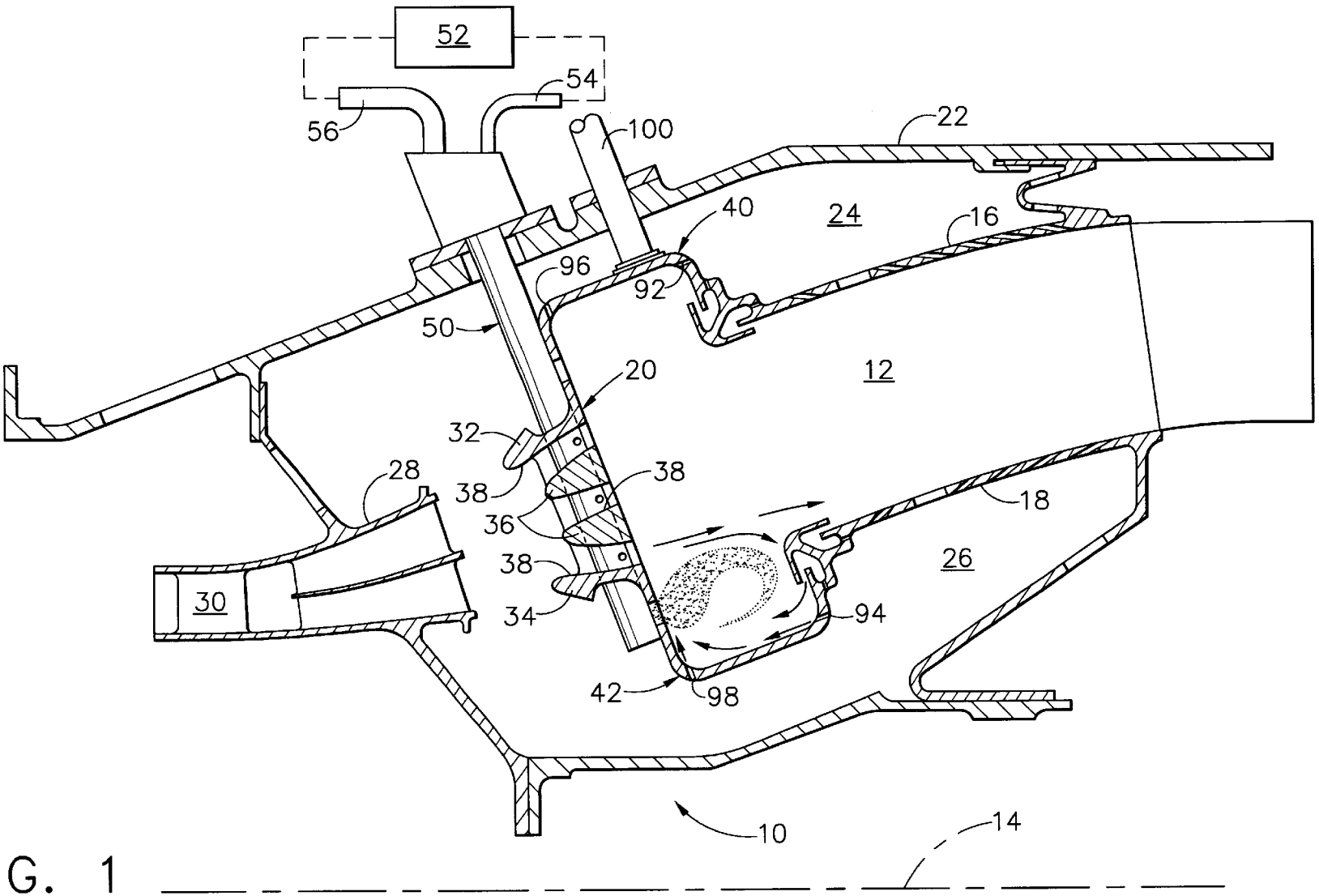
FIG. 1 is a longitudinal cross-sectional view of a gas turbine engine combustor having a fuel injection system in accordance with the present invention.

Referring now to the drawing in detail, wherein identical numerals indicate the same elements throughout the figures. FIG. 1 depicts a combustor 10 which comprises a hollow body defining a combustion chamber 12 therein. Combustor 10 is generally annular in form about an axis 14 and is further comprised of an outer liner 16, an inner liner 18, and a dome inlet module designated generally by the numeral 20. A casing 22 is preferably positioned around combustor 10 so that an outer radial passage 24 is formed between casing 22 and outer liner 16 and an inner passage 26 is defined between casing 22 and inner liner 18.

It will be appreciated that dome inlet module 20 may be like that shown and disclosed in U.S. Pat. No. 5,619,855 to Burrus, which is also owned by the assignee of the current invention and is hereby incorporated by reference. Instead, FIG. 1 depicts combustor 10 as having a different dome inlet module 20, where it is separate from a diffuser 28 located upstream thereof for directing air flow from an exit end 30 of a compressor. Dome inlet module 20, which is connected to outer liner 16 and inner liner 18, preferably includes an outer vane 32, an inner vane 34, and one or middle vanes 36 disposed therebetween so as to form a plurality of flow passages 38. While three such flow passages are shown in FIG. 1, there may be either more or less depending upon the number of middle vanes 36 provided. Preferably, dome inlet module 20 is positioned in substantial alignment with the outlet of diffuser 28 so that a main stream air flow is directed unimpeded into combustion chamber 12. In addition, it will be seen that outer and inner vanes 32 and 34 extend axially upstream in order to better receive the main stream air flow within flow passages 38 of dome inlet module 20.

It will be noted that achieving and sustaining combustion in such a high velocity flow is difficult and likewise carries downstream into combustion chamber 12 as well. In order to overcome this problem within combustion chamber 12, some means for igniting the fuel/air mixture and stabilizing the flame thereof is required. Preferably, this is accomplished by the incorporation of a trapped vortex cavity depicted generally by the number 40, formed at least in outer liner 16. A similar trapped vortex cavity 42 is preferably provided in inner liner 18 as well. Cavities 40 and 42 are utilized to provide a trapped vortex of fuel and air, as discussed in the aforementioned '855 patent and depicted schematically in cavity 42 of FIG. 1.

With respect to outer liner 16 and inner liner 18, trapped vortex cavities 40 and 42 are incorporated immediately downstream of dome inlet module 20 and shown as being substantially rectangular in shape (although cavities 40 and 42 may be configured as arcuate in cross-section). Cavity 40 is open to combustion chamber 12 so that it is formed by an aft wall 44, a forward wall 46, and an outer wall 48 formed therebetween which preferably is substantially parallel to outer liner 16. Likewise, cavity 42 is open to combustion chamber 12 so that it is formed by an aft wall 45, a forward wall 47, and an inner wall 49 formed therebetween which preferably is substantially parallel to inner liner 18. Instead of injecting fuel into trapped vortex cavities 40 and 42 through a fuel injector centered within a passage in aft walls 44 and 45, respectively, as shown in U.S. Pat. No. 5,619,855, it is preferred that the fuel be injected through forward walls 46 and 47 by means of a plurality of fuel injector bars 50 positioned circumferentially around and interfacing with dome inlet module 20.

Figure 4:
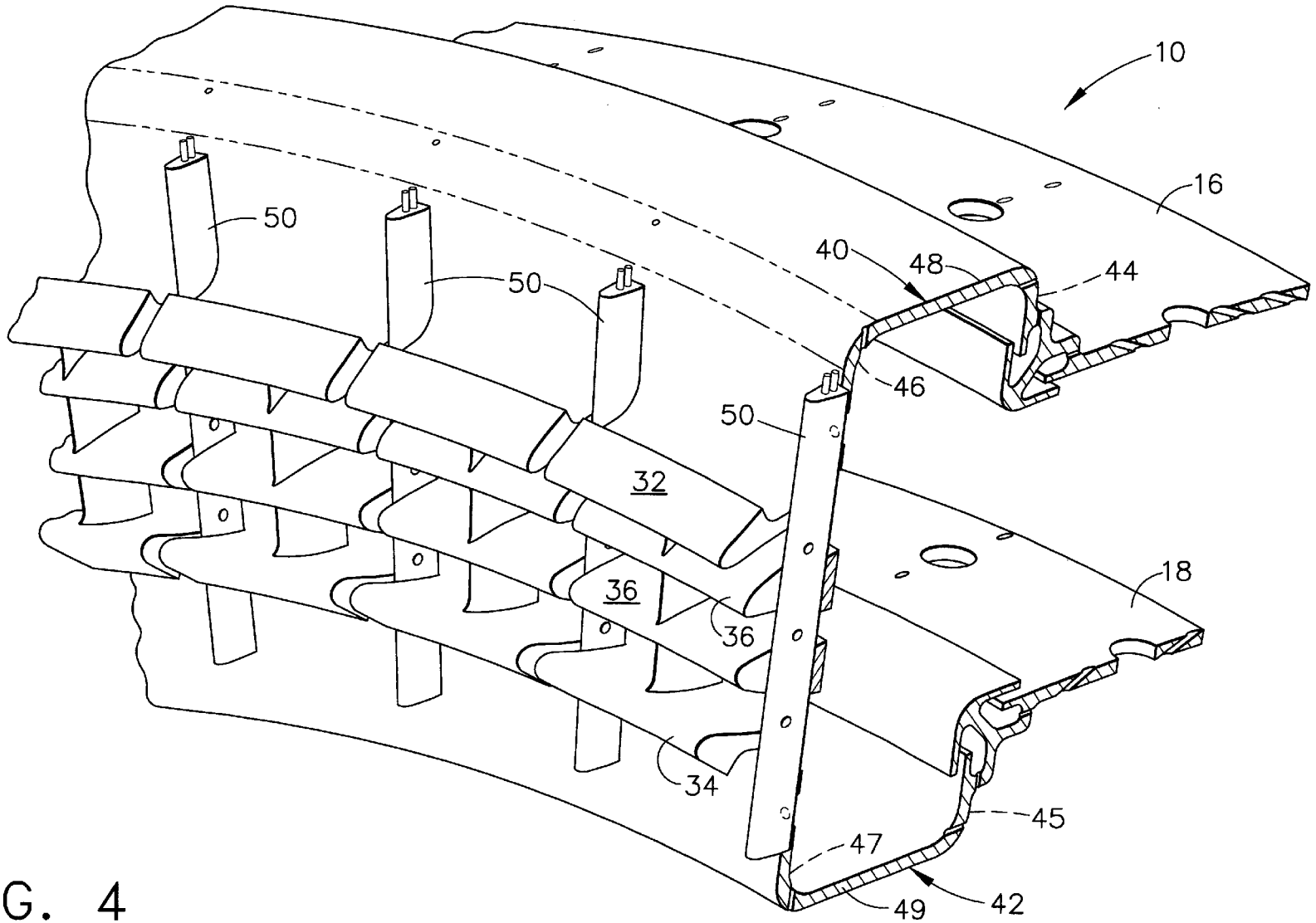
FIG. 4 is a forward perspective view of the dome inlet module depicted in FIG. 1, where the fuel injector bars are shown as interfacing therewith.

More specifically, fuel injector bars 50 are configured to be inserted into dome inlet module 20 through engine casing 22 around combustor 10. Depending upon the design of dome inlet module 20, each fuel injector bar 50 is then inserted into slots provided in vanes 32, 34 and 36 (see FIG. 4) or integrally therewith through openings provided therein. Fuel injector bars 50 are then in flow communication with a fuel supply 52, preferably via separate fuel lines 54 and 56, in order to inject fuel into cavities 40 and 42 and flow passages 38.

Figure 2:
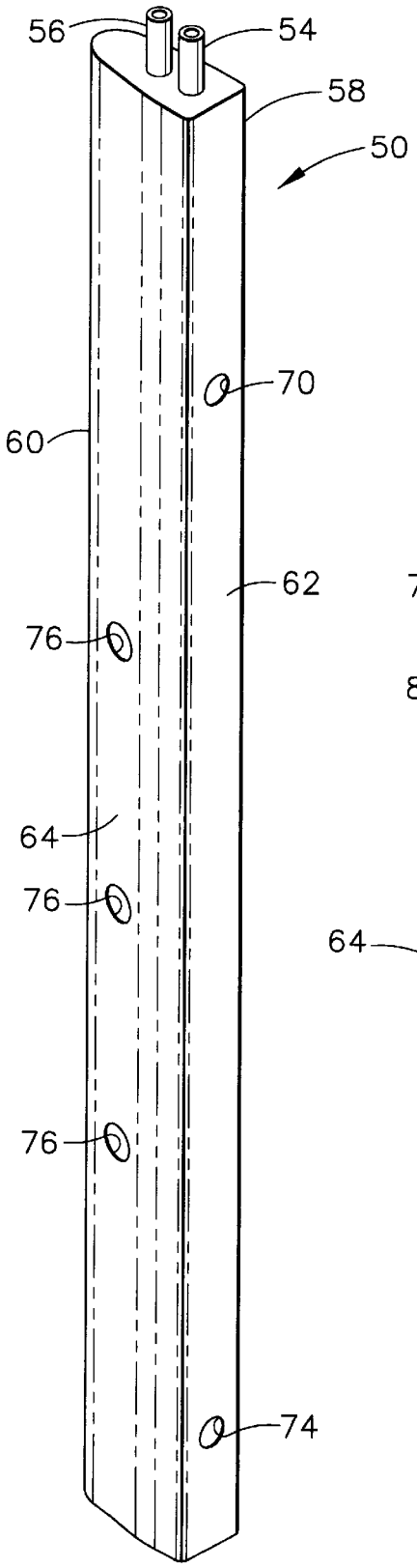
FIG. 2 is an aft perspective view of a single fuel injector bar.
Figure 3:
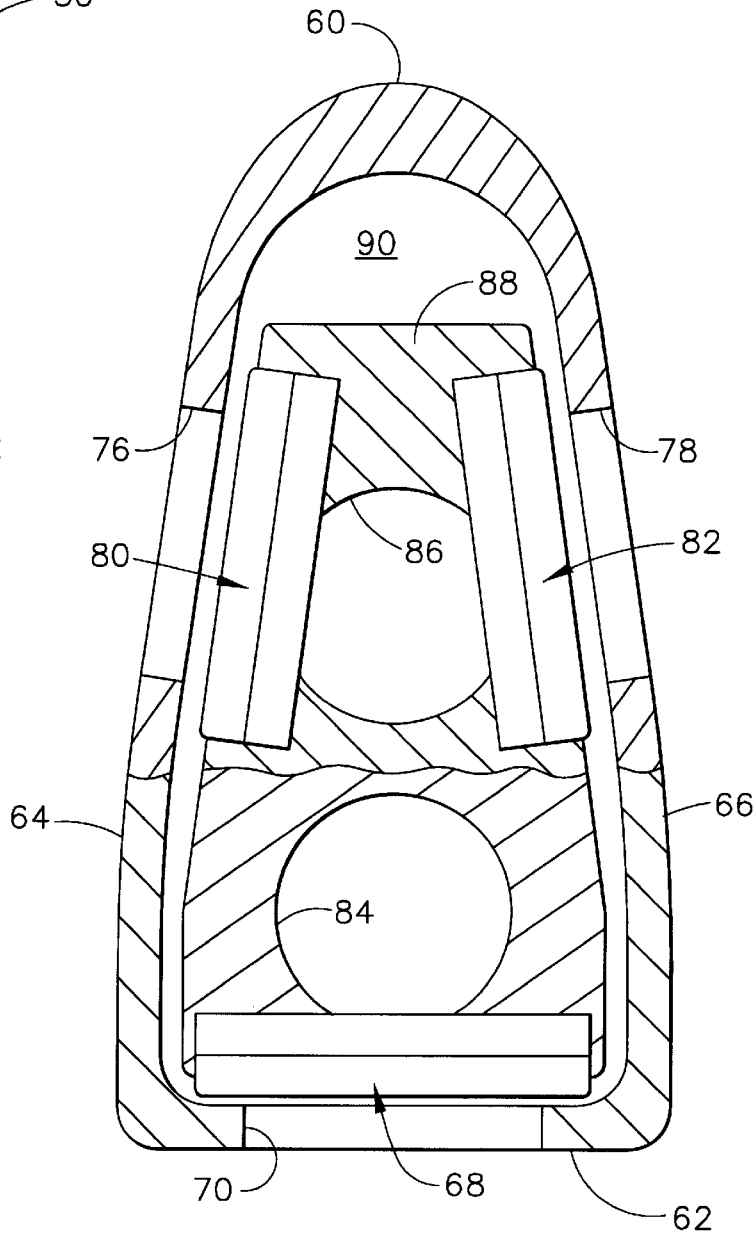
FIG. 3 is a top cross-sectional view of the fuel injector bar depicted in FIG. 2 across two separate planes, whereby flow communication with the side injectors and the aft injectors is shown.

As seen in FIG. 2, each fuel injector bar 50 has a body portion 58 having an upstream end 60, a downstream end 62, and a pair of sides 64 and 66 (see FIG. 3). It will be noted that upstream end 60 is preferably aerodynamically shaped while downstream end 62 has, but is not limited to, a bluff surface. In order to inject fuel into cavities 40 and 42, a first injector 68 is positioned within an opening 70 located at an upper location of downstream end 62 and a second injector 72 is positioned within an opening 74 located at a lower location of downstream end 62. Additionally, a pair of oppositely disposed openings 76 and 78 in sides 64 and 66, respectively, are provided with injectors 80 and 82 to inject fuel within each flow passage 38 of dome inlet module 20.

It will be appreciated from FIG. 3 that body portion 58 operates as a heat shield to the fuel flowing therethrough to injectors 68, 72. 80 and 82. Since it is preferred that injectors 68 and 72 be supplied with fuel separately from injectors 80 and 82 via fuel lines 54 and 56, first and second passages 84 and 86 are provided within fuel injector bars 50. Fuel line 54 is brazed to first passage 84 so as to provide flow communication and direct fuel to injectors 68 and 72 while fuel line 56 is brazed to second passage 86 so as to provide flow communication and direct fuel to injectors 80 and 82. It will be understood that injectors 68, 72, 80 and 82 are well known in the art and may be atomizers or other similar means used for fuel injection.

Although simple tubes could be utilized to carry fuel from fuel lines 54 and 56 to injectors 68, 72, 80 and 82, it is preferred that fuel injector bars 50 be constructed to have a middle portion 88 housed within body portion 58 of fuel injection bars 50 with first and second passages 84 and 86 formed therein. Middle portion 88 is optimally made of ceramic or a similarly insulating material to minimize the heat transferred to the fuel. An additional air gap 90 may also be provided about middle portion 88 where available in order to further insulate the fuel flowing therethrough. It will be appreciated that middle portion 88 is maintained in position within body portion 58 at least by the attachment of fuel lines 54 and 56 at an upper end thereof.

In operation, combustor 10 utilizes the combustion regions within cavities 40 and 42 as the pilot, with fuel only being provided through injectors 68 and 72 of fuel injector bars 50. Air is also injected into cavities 40 and 42 via passages 92 and 94 located at the intersection of aft walls 44 and 45 with outer wall 48 and inner wall 49, respectively, as well as passages 96 and 98 located at the intersection of forward walls 46 and 47 with outer wall 48 and inner wall 49. In this way, a trapped vortex of fuel and air is created in cavities 40 and 42. Thereafter, the mixture of fuel and air within cavities 40 and 42 are ignited, such as by igniter 100, to form combustion gases therein. These combustion gases then exhaust from cavities 40 and 42 across a downstream end of dome inlet module 20 so as to interact with main stream air flowing through flow passages 38. It will be understood that if higher power or additional thrust is required, fuel is injected into flow passages 38 of dome inlet module 20 through injectors 80 and 82 of fuel injector bars 50, such fuel being mixed with the main stream air flowing therethrough. The mixture of fuel and main stream air is preferably ignited by the cavity combustion gases exhausting across the downstream end of dome inlet module 20. Thus, combustor 10 operates in a dual stage manner depending on the requirements of the engine.

Having shown and described the preferred embodiment of the present invention, further adaptations of the fuel injection system, the individual fuel injector bars, and the manner of operating them in the gas turbine engine combustor can be accomplished by appropriate modifications by one of ordinary skill in the art without departing from the scope of the invention.

What is claimed is:

1. A fuel injection system for a gas turbine engine combustor, said combustor including a dome inlet module having a plurality of flow passages formed therein by a plurality of vanes positioned circumferentially therein, a combustion chamber, and at least one trapped vortex cavity formed in a liner downstream of said dome inlet module by an aft wall, a forward wall, and a third wall therebetween, said fuel injection system comprising:

(a) a fuel supply;

(b) a plurality of radially disposed fuel injector bars positioned circumferentially around and interfacing with said inlet dome module and said forward wall, said fuel injector bars being in flow communication with said fuel supply, each of said fuel injector bars further comprising:

(1) a body portion having an upstream end, a downstream end, and a pair of sides;

(2) a plurality of injectors formed in said body portion sides and in flow passages; and (3) at least one injector located on said body portion downstream end of said fuel injector bars in flow communication with said fuel supply to provide fuel into each trapped vortex cavity formed in said liner through said forward wall;

wherein fuel is provided to said dome inlet module flow passages and each said cavity through said fuel injector bars.

2. The fuel injection system of claim 1, said body portion of said fuel injector bars being aerodynamically shaped at said upstream end.

3. The fuel injection system of claim 1, said body portion of said fuel injector bars having a bluff surface at said downstream end.

4. The fuel injection system of claim 1, said fuel injector bars being located integrally within said dome inlet module.

5. The fuel injection system of claim 1, said fuel injector bars being located in openings provided in said vanes of said dome inlet module.

6. The fuel injection system of claim 1, wherein said fuel injector bars are inserted into and extend through said dome inlet module.

7. The fuel injection system of claim 1, further comprising a first fuel supply in flow communication with said fuel injector bars which feeds fuel to said injectors providing fuel into said cavity and a second duel supply in flow communication with said fuel injector bars which feeds fuel to said injectors providing fuel into said dome inlet module flow passages.

8. The fuel injection system of claim 7, said fuel injection bars further comprising a middle portion house with said body portion, said middle portion having a first passage formed therein in flow communication with said first fuel supply and a second passage formed therein in flow communication with said second fuel supply and said injectors formed in said body portion downstream end, wherein fuel flowing through said first and second passages in thermally protected.

9. The fuel injection system claim 1, said fuel injector bars being located in slots provided in said vanes of said dome inlet module.

10. The fuel injection system of claim 1, said gas turbine engine combustor including a first trapped vortex cavity formed in a first liner positioned radially outside said dome inlet module and a second trapped vortex cavity formed in a second liner positioned radially inside said dome inlet module.

11. The fuel injection system of claim 1, said trapped vortex cavity being formed in a liner radially outside said dome inlet module.

12. The fuel injection system of claim 1, said trapped vortex cavity being formed in a liner radially inside said dome inlet module.

13. A method of operating a gas turbine combustor, said combustor including a dome inlet module having a plurality of flow passages formed therein by a plurality of vanes positioned circumferentially therein, a combustion chamber, at least one trapped vortex cavity formed within said combustion chamber by a liner downstream of said dome inlet module by an aft wall, a forward wall, and a third wall therebetween, and at least one fuel injector bar interfacing with the flow passages of said dome inlet module and said forward wall, said method comprising the following steps:

(a) injecting fuel via said at least one fuel injector bar into an upstream end of said trapped vortex cavity;

(b) injecting air into said trapped vortex cavity to create a trapped vortex of fuel and air therein;

(c) igniting said mixture of fuel and air in said trapped vortex cavity to form combustion gases;

(d) providing a flow of main stream air form a compressor upstream of said dome inlet module into and through said flow passages;

(e) injecting fuel via said at least one fuel injector bar into said dome inlet module flow passages so as to mix with said main stream air;

(f) exhausting said trapped vortex cavity combustion gases across a downstream end of said dome inlet module so as to interact with said mixture of fuel and main stream air; and (g) igniting the mixture of fuel and main stream air by said trapped vortex cavity combustion gases exhausting across said dome inlet module downstream end.

14. The method of claim 13, wherein the mixture of fuel and air and said trapped vortex is less than an equivalence ratio of 1.0.

* * * * *